US005492137A

United States Patent [19]

Giblin et al.

[11] Patent Number: 5,492,137

[45] Date of Patent: Feb. 20, 1996

[54] MODULAR PARTS WASHING SYSTEM

[75] Inventors: Jay P. Giblin, Cheshire; Gary F. Nowak, Newington, both of Conn.

[73] Assignee: Nowak Products, Inc., Newington, Conn.

[21] Appl. No.: 272,557

[22] Filed: Jul. 11, 1994

[51] Int. Cl.[6] ..... B08B 3/02

[52] U.S. Cl. ..... 134/60; 134/107; 134/108; 134/153; 134/158

[58] Field of Search ..... 134/60, 86, 88, 134/89, 90, 91, 92, 105, 107, 108, 153, 158; 68/27

[56] References Cited

U.S. PATENT DOCUMENTS

| | | | |
|---|---|---|---|
| 1,426,400 | 8/1922 | McCarty | 134/105 X |
| 1,698,778 | 1/1929 | Clark | 68/27 X |
| 1,878,254 | 9/1932 | Warren | 68/27 X |
| 2,562,076 | 7/1951 | Weisselberg | 134/158 X |
| 2,675,012 | 4/1954 | Scales | 134/91 X |
| 4,237,912 | 12/1980 | Hill et al. | 134/158 X |
| 5,331,986 | 7/1994 | Lim et al. | 134/88 |

FOREIGN PATENT DOCUMENTS

| | | | |
|---|---|---|---|
| 860528 | 2/1961 | United Kingdom | 68/27 |

*Primary Examiner*—Philip R. Coe
*Attorney, Agent, or Firm*—Ira S. Dorman

[57] ABSTRACT

A system for washing parts utilizing a circulated, heated liquid includes a master unit and at least one auxiliary unit. The master unit has a tank for heating the washing liquid, and has a pump for circulating the liquid through the chamber of the enclosure. The auxiliary unit is devoid of such a tank, but has means for making connections necessary to enable circulation of the liquid heated in the tank of the master unit through the chamber of the auxiliary unit enclosure.

7 Claims, 2 Drawing Sheets

MODULAR PARTS WASHING SYSTEM

BACKGROUND OF THE INVENTION

It is common in industrial settings to provide units for washing parts in bulk. Such units typically employ a heated liquid (water or an organic solvent) that is sprayed upon parts contained within a basket, which is rotatably mounted within an enclosure.

In many instances the washing unit available will be either too large or too small for the size or volume of parts to be cleaned, as a result of which the economical utilization of power and space is compromised. The provision of a number of cleaning units having different capacities is an expensive response to the problem, not only from the standpoint of capital outlay but also due to the need to comply with documentation requirements (to satisfy state and federal regulations) for each piece of equipment. When several units are to be kept in service, moreover, it is, as a practical matter, necessary to maintain a supply of chemicals (e.g., detergent) on the premises and within each unit.

SUMMARY OF THE INVENTION

Accordingly, it is the broad object of the present invention to provide a novel parts-washing system in which typical costs, and inconveniences of use, are reduced from levels that would otherwise be encountered.

A more specific object of the invention is to provide such a system in which at least one auxiliary unit shares the heating and pumping facilities of a master unit, thereby affording the advantages hereinabove referred to.

It has now been found that the foregoing and related objects of the invention are attained by the provision of a system for washing parts, comprising a master unit and at least one auxiliary unit, each unit including an enclosure for the containment of parts to be washed, and having associated means for introducing and withdrawing liquid into and from the enclosure. A heater is operatively connected for receiving water from the liquid-withdrawal means of the master unit, and a pump has an intake side, operatively connected for taking liquid from the heater, and an outlet side operatively connected for delivering liquid to the liquid-introduction means of the master unit. The liquid-introduction means of the auxiliary unit is constructed for operative connection to the outlet side of the pump, and the liquid withdrawal means thereof is constructed for operative connection to the heater. As a result, heated liquid can be circulated through the enclosure of either the master unit or the auxiliary unit by selective, operative connection thereof to the heater and pump of the master unit.

The system of the invention will normally include a conduit connected to the outlet side of the pump and constructed for operative connection to the liquid-introduction means of either the master unit or the auxiliary unit. The liquid-introduction means will preferably comprise nozzle means for spraying liquid into the interior of the associated enclosure, and at least one of the units will advantageously include a basket for the containment of parts to be washed, the basket being rotatably mounted within the enclosure in the path of discharge from the spray nozzles thereof.

DETAILED DESCRIPTION OF THE ILLUSTRATED EMBODIMENTS

Figure 1:
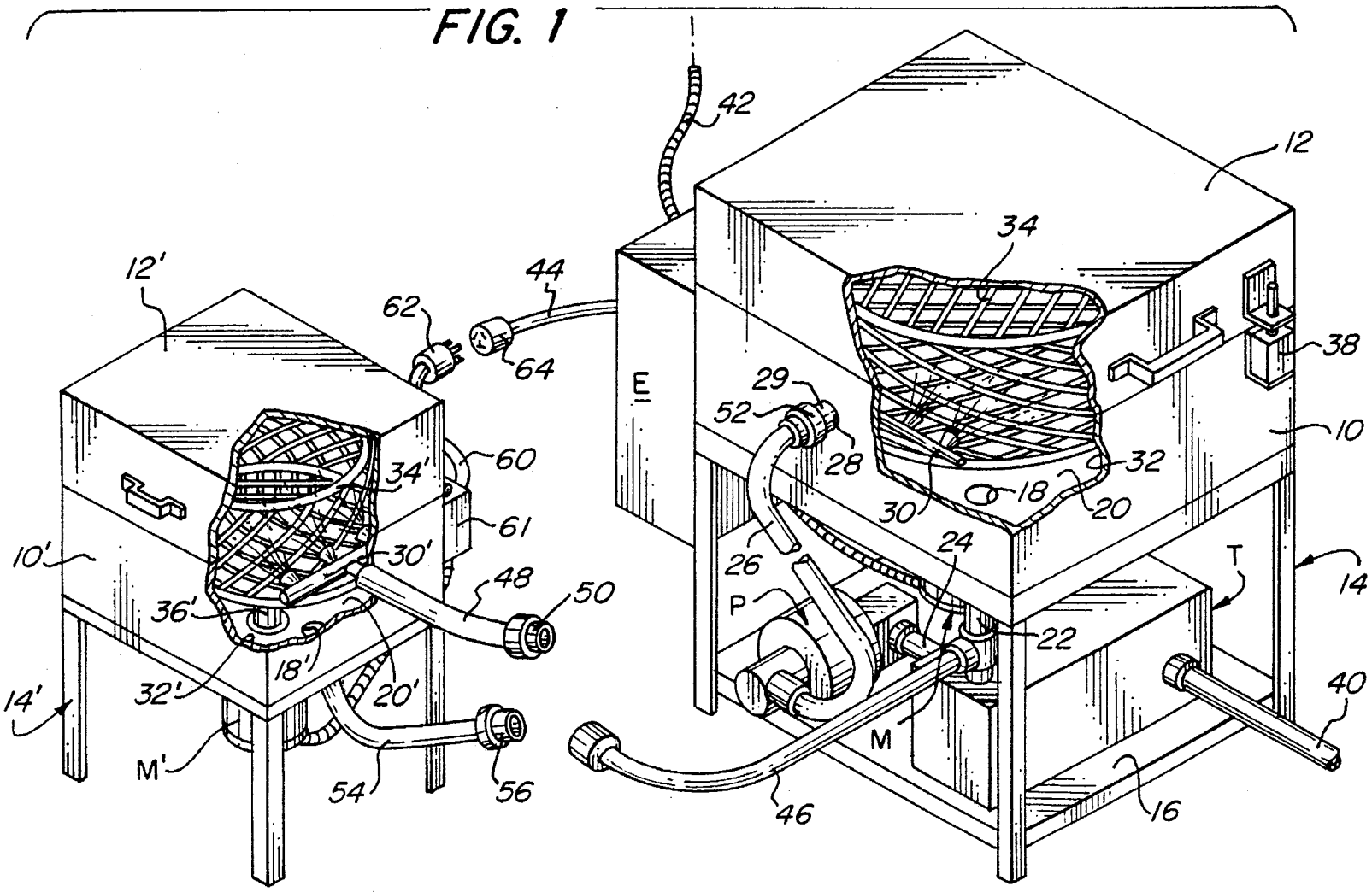
FIG. 1 of the drawings is a perspective view of a system embodying the present invention, with portions of the enclosures of the constituent units being broken away to show internal features.

Turning initially to FIG. 1 of the drawings, therein illustrated is a system embodying the present invention and consisting of two washing units. The larger, "master" unit comprises an enclosure consisting of a base 10 and a cover 12, hingedly secured to one another (by means not shown). The enclosure is seated upon a stand 14, the shelf 16 of which supports a pump "P" and a tank "T"; the tank includes internal heating coils (also not shown).

A drain opening 18 is formed through the bottom wall 20 of the enclosure base 10, and is connected by a pipe 22 to the interior of the tank "T". A second pipe 24 leads from the tank "T" to the intake side of the pump "P", and a flexible hose 26 is connected to the outlet side of the pump. In the configuration illustrated, the hose 26 is joined to a short piece 29 of piping, which extends through the sidewall aperture 28 of the enclosure base 10 and into communication with the spray head 30, disposed within the enclosure chamber 32.

An open-mesh basket 34 is rotatably mounted within the chamber 32 on a shaft 36, which extends through the wall 20 into driven connection with the electric motor "M". Separate components of a disconnect switch 38 are mounted on the base 10 and cover 12 of the enclosure, and cooperatively serve to make and break the electric power circuit that is established through cable 42 and junction box "E".

In one mode of operation, water (or other washing liquid) supplied to the tank "T" through the fill tube 40 is heated and delivered to the chamber 32, passing through the pipe 24, the pump "P", hose 26, the nozzle head 30, drain opening 18, and pipe 22.

The smaller, "auxiliary" unit of the system has components in common with the master unit, to the extent of which the same numbers, differentiated by priming them, are employed. It will be noted however that the auxiliary unit includes no heating tank and no circulation pump, utilizing instead those components of the master unit, which is suitably adapted for such service.

More particularly, the auxiliary unit includes a length of hose 48, which is connected to the nozzle head 30' at one end and mounts the male component 50 of a quick-disconnect coupling fixture at its opposite end; a cooperating female component 52 is disposed on the free end of the hose 26. Similarly, a length of hose 54 leads from the drain opening 18' in the bottom wall 20' of the enclosure base 10', and carries a male coupling component 56 which is adapted to engage the female component 58 on the end of the pipe 46.

With the pipe 46 connected to the hose 54, and the hose 26 connected to the hose 48 rather than the pipe section 29 (which also carries a male component 50 thereon, not visible), the pump "P" will operate to draw heated liquid from the tank "T" and to cause it to be injected through the nozzle head 30' upon parts contained within the basket 34'. The liquid will thereafter flow through the drain opening 18' and the hose sections 54 and 46, returning to the tank "T" through the pipe 22. Power for the motor "M'" of the auxiliary unit is received through line 60 and junction box 61, by connecting the male plug 62 to the receptacle 64 on the end of the cord 44, which leads from the junction box "E".

Figure 2:
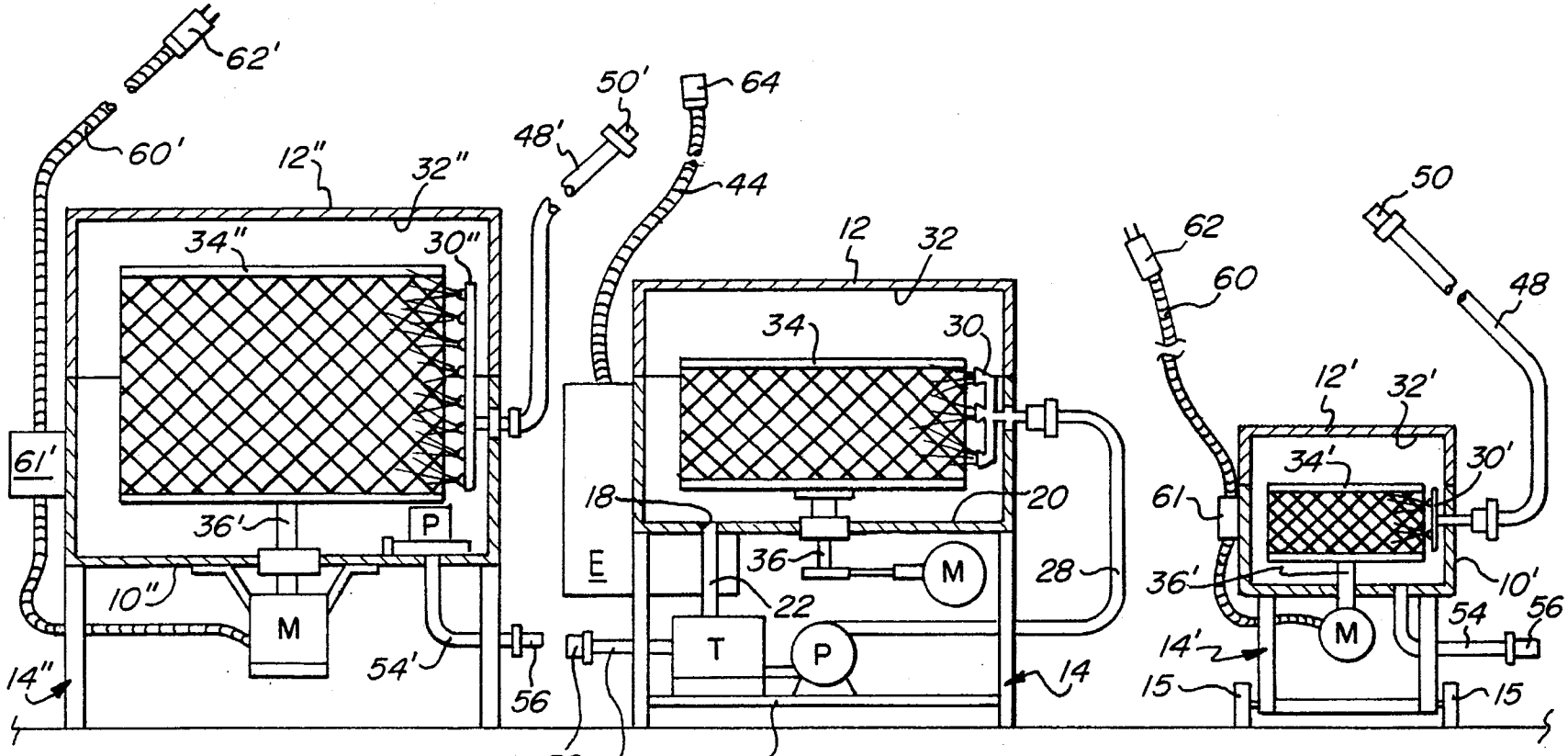
FIG. 2 is a diagrammatic, elevational view of an augmented form of systems embodying the invention, the enclosures of the units of which it is comprised being shown in vertical cross section.

FIG. 2 of the drawings diagrammatically illustrates a system like that of FIG. 1 but augmented with a second auxiliary unit. Here again, parts and components of the second auxiliary unit that are common to the other two units are designated by the same numbers, differentiated however by double primes; a single prime is added where the part is common to the first auxiliary unit only.

Apart from the larger size of the second auxiliary unit (giving it a capacity greater than even the master unit), it differs from the first auxiliary unit primarily by the inclusion of a supplemental pump "p". That pump incorporates a float, and functions to maintain a desired level of liquid in the chamber 32"; pump "p" does not obviate the need for using pump "P" to deliver heated liquid to the second auxiliary unit.

As is also shown in FIG. 2, the first auxiliary unit may be modified by providing wheels 15 on the legs of the stand 14'. This would of course afford added mobility, further enhancing the usefulness of the auxiliary unit and underscoring the novelty of the invention. Although the foregoing description indicates that the circulation pump and heater are to be connected to the enclosure of either the master unit or an auxiliary unit, it will be appreciated that suitable piping may be provided for having the heated liquid delivered to, and returned from, two or more enclosures concurrently.

Thus, it can be seen that the present invention provides a novel parts-washing system in which typical costs, and inconveniences of use, are reduced from levels that would otherwise be encountered. Those advantages are realized by including in the system at least one auxiliary unit that shares the heating and pumping facilities of the master unit.

Having thus described the invention, what is claimed is:

1. A system for washing parts utilizing a circulated, heated liquid, comprising a master unit and at least one separate auxiliary unit, each of said units including an enclosure for the containment of parts to be washed, said enclosure of said master unit having a volumetric capacity that is substantially different from the volumetric capacity of said enclosure of said auxiliary unit, and each of said units having associated liquid-introduction means for introducing liquid into said enclosure thereof, and liquid-withdrawal means for withdrawing liquid therefrom, said master unit additionally including a heater operatively connected for receiving liquid from said liquid-withdrawal means of said master unit, and a pump having an intake side operatively connected for taking liquid from said heater and an outlet side operatively connected for delivering liquid to said liquid-introduction means of said master unit; said liquid-introduction means of said auxiliary unit being constructed for operative connection to said outlet side of said pump of said master unit, and said liquid withdrawal means of said auxiliary unit being constructed for operative connection to said heater of said master unit, independently of said enclosure of said master unit, whereby liquid can be heated and circulated through each of said enclosures of said master unit and said auxiliary unit, independently of one another, by operative connection of said each enclosure to said heater and pump of said master unit.

2. The system of claim 1 wherein said system includes at least one conduit for liquid flow, said conduit being operatively connected to said outlet side of said pump and being constructed for operative connection to said liquid-introduction means of said master unit or said auxiliary unit, selectively.

3. The system of claim 1 wherein said liquid-introduction means comprises spray nozzle means for spraying liquid into the interior of the associated enclosure.

4. The system of claim 3 wherein at least one of said units includes a basket for the containment of parts to be washed, said basket being rotatably mounted within said enclosure of said one unit in the path of discharge from said spray nozzle means thereof, and said one unit further including a motor for effecting rotation of said basket.

5. The system of claim 1 wherein said enclosure of said master unit has a volumetric capacity larger than said enclosure of said auxiliary unit.

6. The system of claim 1 wherein said enclosure of said master unit has a volumetric capacity smaller than said enclosure of said auxiliary unit.

7. The system of claim 1 wherein said system further includes a second said auxiliary unit, said enclosure of said master unit having a volumetric capacity larger than said enclosure of the first-mentioned auxiliary unit and smaller than said enclosure of said second auxiliary unit.

* * * * *